United States Patent [19]

Bell et al.

[11] Patent Number: 4,871,179

[45] Date of Patent: Oct. 3, 1989

[54] INFLATABLE PACKER WITH ROUGHENED MANDREL

[75] Inventors: William T. Bell, Huntsville; Richard C. Ellis; Robert E. Snyder, both of Kingwood, all of Tex.

[73] Assignee: Completion Tool Company, Houston, Tex.

[21] Appl. No.: 460,313

[22] Filed: Jan. 24, 1983

[51] Int. Cl.[4] ..... F16J 15/46; E21B 33/127; F16L 33/16

[52] U.S. Cl. ..... 277/34.6; 277/1; 166/187; 285/328; 285/332.4

[58] Field of Search ..... 277/1, 34, 34.3, 34.6; 166/179, 187, 285; 285/DIG. 4, 328, 332.4

[56] References Cited

U.S. PATENT DOCUMENTS

| | | | |
|---|---|---|---|
| Re. 30,711 | 8/1981 | Suman | 166/285 |
| 1,955,642 | 4/1934 | Laughlin | 285/328 X |
| 2,147,343 | 2/1939 | Hokanson | 285/332.4 X |
| 2,196,668 | 4/1940 | Ragan | 277/34 X |
| 2,222,014 | 11/1940 | Baker | 277/34 X |
| 3,437,142 | 4/1969 | Conover | 277/34 X |
| 3,604,732 | 9/1971 | Malone | 277/34 X |
| 3,837,947 | 9/1974 | Malone | 277/34 X |
| 3,907,034 | 9/1975 | Suman | 166/250 |
| 3,918,522 | 11/1975 | Suman | 166/285 |
| 3,961,667 | 6/1976 | Mitchell | 166/187 |
| 4,311,314 | 1/1982 | Suman | 277/34 |

FOREIGN PATENT DOCUMENTS

| | | | |
|---|---|---|---|
| 440923 | 1/1936 | United Kingdom | 277/1 |
| 499480 | 1/1939 | United Kingdom | 277/134 |
| 1238230 | 7/1971 | United Kingdom | 285/328 |
| 1288648 | 9/1972 | United Kingdom | 285/328 |

*Primary Examiner*—Robert S. Ward

[57] ABSTRACT

An inflatable packer including a tubular mandrel, a pair of collars secured to the mandrel, and an inflatable sleeve connected between the collars about the mandrel. The exterior surface of the mandrel underlying the sleeve is roughened to increase the coefficient of friction between the mandrel and the sleeve.

6 Claims, 1 Drawing Sheet

INFLATABLE PACKER WITH ROUGHENED MANDREL

BACKGROUND OF THE INVENTION

1. Field of the Invention

The present invention relates generally to packers for use in oil and gas wells for providing annular seals between the outside of pipe and the surrounding surface of the borehole or casing, and more particularly to inflatable packers having long inflatable sleeves adapted to be inflated with a cement slurry, having means for increasing the friction between the pipe and the inflatable sleeve.

2. Description of the Prior Art

Inflatable packers of the type disclosed, for example, in U.S. Pat. No. 3,604,732, or U.S. Pat. No. 3,837,947, have been used for many years. Such packers include a tubular mandrel that is covered by an inflatable sleeve secured to the mandrel by a pair of axially spaced apart collars. The sleeve is normally reinforced by a reinforcing sheath, which comprises a plurality of overlapping ribs connected between the collars. Valve means are provided for allowing inflating fluid to enter between the exterior of the mandrel and the inflatable sleeve to inflate the sleeve into sealing contact with the wellbore or casing. Such inflatable packers function to isolate the annulus above the packer from that below and, accordingly, need to be only of a length long enough to form an effective seal.

More recently, there have been developed inflatable packers for use in well completion, which are adapted to be positioned adjacent the producing zone and inflated with cement. After the cement has set, the packer is perforated and the well is produced through the packer. Examples of such inflatable packers are disclosed, for example, in U.S. Pat. No. 3,918,522, U.S. Pat. No. Re. 30,711, and U.S. Pat. No. 3,907,034. Such inflatable packers tend to be relatively long, i.e. from 10 feet to 40 feet in length, in order to seal against both the producing formation, which is perforated, and the formations above and below the producing formation.

Since the completion type inflatable packers are of such length, the central portion of the inflatable sleeve is supported and, in effect, reinforced by the borehole. Accordingly, a reinforcing sheath is unnecessary in the central part of the inflatable sleeve. However, reinforcing is necessary adjacent the ends of the inflatable sleeve to prevent the inflatable sleeve from extruding past the securing collars or blowing out. Therefore, the inflatable sleeves of the completion type packers are normally reinforced only at the ends adjacent the securing collars.

As inflatable packers are run into the borehole, there is sometimes contact between the inflatable sleeve and the borehole wall. Such contact is particularly likely in deviated holes. Contact between the sleeve and the borehole wall during movement causes frictional forces to be applied to the sleeve that tend to move the sleeve with respect to the mandrel. In short length inflatable packers with continuous reinforcing sheaths, the reinforcing sheath provides a measure of stiffness to the sheath which prevents axially movement due to frictional wellbore contact. However, in the case of long packers with largely unreinforced inflatable sleeves, when the coefficient of friction between the wellbore and the sleeve exceeds the coefficient of friction between rubber and the mandrel, the sleeve can move with respect to the mandrel. Such movement can cause thickening of the sleeve at the upper end of the inflatable packer and can deform outwardly the upper reinforcing material, in some instances, the movement of the sleeve along the mandrel can cause the diameter of the packer to become greater than that of the borehole, in which case the packer becomes stuck.

A solution to the problem of movement of the inflatable sleeve with respect to the mandrel is provided in U.S. Pat. No. 4,311,314, which discloses an inflatable packer having an inflatable sleeve mounted on a tubular mandrel that is covered with a gritty sand paper-like material. The grit particles are bonded to the outer surface of the mandrel by a suitable binder, such as an epoxy resin, as for example the adhesive sold under the trademark EPON by Shell Chemical Corporation. The coefficient of friction of the inflatable sleeve on the grit covered surface is much higher than the coefficient of friction between the inflatable sleeve and a borehole wall. Accordingly, the improvement of U.S. Pat. No. 4,311,314, very effectively solves the problem of the movement of the inflatable sleeve with respect to the mandrel.

However, there has been developed recently, new cement bond log equipment that is gaining substantial industry acceptance. Unfortunately, epoxy resin acoustically decouples steel from cement. While the bond between the mandrel and the epoxy and between the epoxy and the cement may be perfectly good, the new cement bond logging equipment indicates that proper bonding has not been achieved.

It is therefore an object of the present invention to provide an inflatable packer having a high coefficient of friction between the mandrel and the inflatable sleeve without including a grit like coating.

SUMMARY OF THE INVENTION

Briefly stated, the foregoing and other objects are accomplished by the inflatable packer of the present invention. The inflatable packer includes a tubular mandrel that is covered by an elastic sleeve. The ends of the elastic sleeves are connected to and sealed with the mandrel by a pair of spaced apart collars. One of the collars has means for allowing inflating fluid to enter between the inflatable sleeve and the mandrel to inflate the sleeve. The tubular mandrel is casing that has an outside diameter and wall thickness greater than the minimums set by A.P.I. for casing. The exterior surface of the tubular mandrel is roughened to provide an increased coefficient of friction with the inflatable sleeve. The surface depth of the roughening is such that the outside diameter and wall thickness of the mandrel within the roughening remains greater than A.P.I. minimums. Preferably, the roughened exterior is provided by knurling.

DESCRIPTION OF THE PREFERRED EMBODIMENT

Figure 1:
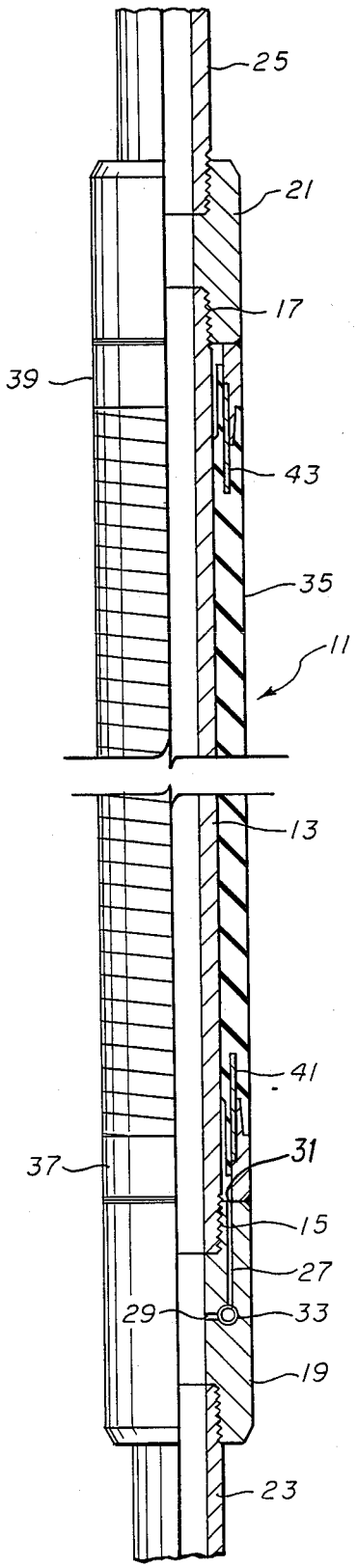
FIG. 1 is a quarter sectional view of a packer of the preferred embodiment of the present invention.

Referring now to the drawing, and first to FIG. 1, the inflatable packer of the present invention is designated generally by the numeral 11. Packer 11 includes a tubular mandrel 13, which in the preferred embodiment is a length of casing or the like having threaded portions 15 and 17 at its respective ends. Threaded portions 15 and 17 are adapted to receive and connect with, respectively, a valve collar 19 and a blank collar 21, which in turn are adapted to be connected between adjacent other tubular members 23 and 25 respectively to form a string of pipe.

Valve collar 19 is of the type disclosed generally in U.S. Pat. No. 3,437,142, and includes a passageway 27, having an inlet 29 and an outlet 31, for the flow of inflating fluid therethrough. Passageway 27 includes valves means 33 for preventing the flow of inflating fluid through passageway 27 until a certain preselected pressure differential is achieved and for preventing flow of fluid from outlet 31 to inlet 29.

Inflatable packer 11 includes an inflatable sleeve 35 of a rubber-like elastomer positioned about tubular mandrel 13 and connected between collars 19 and 21 by a pair of spaced apart heads 37 and 39, respectively. Heads 37 and 39, respectively, have connected thereto longitudinally extending reinforcing elements 41 and 43. In the preferred embodiment, reinforcing elements 41 and 43 comprise a plurality of longitudinally extending overlapping ribs connected at one end to the heads and extending into and embedded in the material of inflatable sleeve 35. As inflatable sleeve 35 is inflated, the ribs of reinforcing elements 41 and 43 separate and expand.

Figure 2:
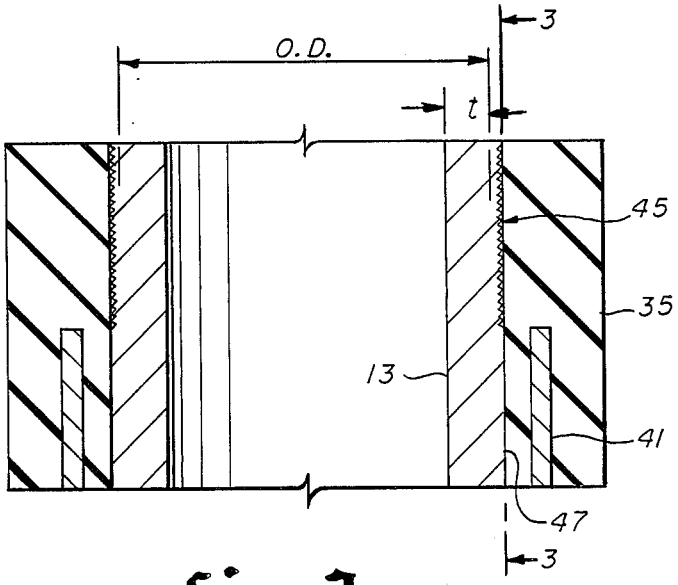
FIG. 2 is an enlarged sectional view showing the interface between the tubular mandrel and the inflatable sleeve of the present invention.
Figure 3:
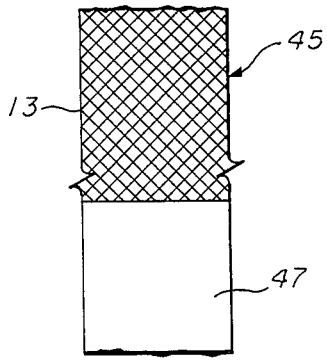
FIG. 3 is a view taken along line 3—3 of FIG. 2, showing a detail of a portion of the surface of the mandrel of the inflatable packer of the present invention.

Referring now to FIG. 2, there is shown in detail the interface between tubular mandrel 13 and inflatable sleeve 35. FIG. 2 depicts a portion of such interface in the vicinity of lower reinforcing element 41. As shown in FIG. 2, the exterior surface of tubular mandrel 13 axially above the end of lower reinforcing element 41 is roughened, as indicated generally at 45. The roughened exterior surface 45 extends axially upwardly to the vicinity of the lower end of upper reinforcing element 43. As shown in FIG. 3, in the preferred embodiment, roughened surface 45 is formed by a plurality of closely spaced apart orthogonal grooves which present a knurled appearance. In the preferred embodiment, the grooves of roughened surface 45 are formed by brinelling the surface with a plurality of rollers. However, those skilled in the art will recognize alternative methods of forming the knurling pattern, as for example, by scratching or cutting the surface of tubular mandrel 13. Also, in the preferred embodiment, the grooves which comprise knurl surface 45 are pluralities of orthogonal helical grooves, but those skilled in the art will recognize other patterns as for examples orthogonal longitudinal and circumferential grooves. While roughened surface 45 is preferably formed by knurling, those skilled in the art will recognize alternative methods of roughening the pipe. For example, roughened surface 45 may be formed by abrasive sand or grit blasting, chemical pitting, or the like.

It is important, during the formation or roughened surface 45, that the grooves not be so deep as to make the wall thickness of tubular mandrel 13 less than the minimum wall thickness and outside diameter specified by the American Petroleum Institute for casing of the diameter of tubular mandrel 13. Thus, prior to formation of roughened surface 45, pipe from which tubular mandrel 13 is formed is selected to have an outside diameter O.D. and wall thickness t greater than the minimums set by API Specification. The depth of roughening by knurling or the like is then selected such that after roughening, the outside diameter and wall thickness of the pipe radially beneath the roughening remains at least equal to the API Specification minimums. For example, the API Specification specifications require that for casing greater than 4½ inch outside diameter, the tolerances for outside diameter be ±0.75% and for wall thickness be −12.5%. Thus, for 7 inch 26.0 pound per foot casing, the outside diameter may vary from 6.9475 inches to 7.0525 inches. The wall thickness specified for such casing is 0.362 inches, but may be, within tolerance, as low as 0.316 inches. The pipe is thus selected having an outside diameter and wall thickness greater than the respective minimums and the depth the roughening is selected such that the undisturbed material underlying the roughening is equal to or greater than the minimums. It has been discovered that the grooves of roughened surface 45 need not be very deep in order to provide a substantial coefficient of friction with the rubber-like material of inflatable sleeve 45. Indeed, grooves less than 0.05 inches in depth will increase substantially the coefficient of friction.

Referring still to FIGS. 2 and 3, tubular mandrel 13 includes a smooth outer surface 47 axially below the end of reinforcing element 41. Tubular mandrel 13 includes a similar smooth surface axially above the end of upper reinforcing element 43. Smooth portion 47 allows lower head 31 with reinforcing element 41 embedded in the rubber-like material to be slipped axially thereon and to be interconnected with valve collar 19. Upper head 39 with reinforcing element 34 may likewise be slipped over the axially upper smooth portion of tubular mandrel 13 and interconnected with collar 21. With heads 37 and 39 so positioned, the remainder of inflatable sleeve 35 may be laid in strip-wise fashion upon tubular mandrel 13 and cured in place. The material of sleeve 35 conforms to and interfits with roughened surface 45 of tubular mandrel 13.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. An inflatable packer for use in a well bore comprising:

a tubular mandrel constructed of a load supporting steel pipe member, said tubular mandrel having a length of ten feet or more, an elastomeric tubular sleeve disposed on said tubular mandrel and attached at its ends to said tubular mandrel, said tubular sleeve normally being in contact with the outer surface of said tubular mandrel and being adapted to expand outwardly relative to said tubular mandrel into contact with the wall of a well bore upon the application of a cement slurry fluid upon pressure between said tubular sleeve and said tubular mandrel, and said steel pipe member having an irregular outer surface configuration along its length providing protrusions along the said outer surface configuration for engagement with the tubular sleeve so that said irregular outer surface configuration provides a substantial coefficient of friction for preventing the tubular sleeve from relative longitudinal displacement relative to the steel pipe member while going in the well bore and so that upon expansion of the tubular sleeve, the cement slurry fluid is in direct contact with the tubular mandrel and the tubular sleeve whereby a cement bond log can be obtained in a well bore through the length of said steel pipe member.

2. The packer as defined in claim 1 wherein said irregular outer surface configuration consists of closely spaced grooves where the depth of the grooves and the height of the projections defining the edges of the grooves are within predetermined diameter tolerances.

3. The inflatable packer as claimed in claim 1, wherein said irregular outer surface configuration is defined by a plurality of first helical grooves formed in the exterior of said stel pipe member and of second helical grooves formed in said exterior of said steel pipe member substantially orthogonal to said first helical grooves.

4. A method of making an inflatable packer for use in a well bore, which comprises the steps of:

roughening the exterior surface of a metal tubular mandrel at least ten feet in length along its length;

covering the roughened exterior surface of the metal tubular mandrel with an inflatable elastomer sleeve disposed in frictional contact with the roughened exterior surface for the purpose of preventing relative longitudinal displacement of the inflatable sleeve relative to the tubular mandrel, and for avoiding the use of acoustical inhibiting materials between said sleeve and said tubular mandrel so that in a well bore, a cement bond log can be obtained through the length of said tubular mandrel;

and sealingly connecting the ends of the inflatable sleeve to the tubular mandrel so that the inflatable sleeve may be inflated relative to the tubular mandrel upon the application of a cement slurry fluid under pressure while in a well bore.

5. The method as claimed in claim 4, wherein the roughening step includes the steps of:

forming a plurality of first helical grooves in the exterior surface of the tubular mandrel.

6. The method as claimed in claim 5, wherein the roughening step includes the step of:

forming a plurality second helical grooves in the exterior surface of the tubular member substantially orthogonal to first helical grooves.

* * * * *